US005946809A

United States Patent [19]

Bright

[11] Patent Number: 5,946,809

[45] Date of Patent: Sep. 7, 1999

[54] DRYWALL OUTLET CUTTER

[76] Inventor: Steven M. Bright, 742 St. Mary's Rd., Villa Ridge, Mo. 63089

[21] Appl. No.: 08/910,289

[22] Filed: Aug. 13, 1997

[51] Int. Cl.[6] ..... B26F 1/32

[52] U.S. Cl. ..... 30/361; 30/305; 30/358

[58] Field of Search ..... 30/358, 359, 361, 30/178, 305, 304, 315, 316, 299.2, 280, 445

[56] References Cited

U.S. PATENT DOCUMENTS

| | | | |
|---|---|---|---|
| 3,888,068 | 6/1975 | Zambrano . | |
| 4,087,913 | 5/1978 | Jackson . | |
| 4,335,511 | 6/1982 | Bowling . | |
| 4,730,395 | 3/1988 | Blessing, Sr. . | |
| 4,796,361 | 1/1989 | Neal | 30/305 X |
| 4,951,395 | 8/1990 | Lameiro . | |
| 4,969,269 | 11/1990 | Dominguez . | |
| 5,048,190 | 9/1991 | Aurness et al. . | |

FOREIGN PATENT DOCUMENTS

| | | | |
|---|---|---|---|
| 52870 | 9/1910 | Switzerland | 30/445 |

*Primary Examiner*—Douglas D. Watts
*Attorney, Agent, or Firm*—Polster, Lieder, Woodruff & Lucchesi, L.C.

[57] ABSTRACT

A device for cutting openings having a predetermined shape in a drywall panel includes a housing with a base and an integrally formed side wall extending outwardly from the periphery of the base in a substantially perpendicular fashion. The base and the side wall defining a cavity therebetween. A strike plate is slidably received inside the cavity, and has a shape corresponding to that of the predetermined shape of the opening. The strike plate is movable within the cavity between a normally retracted position, wherein the strike plate is maintained in abutment with the base, and an extended position. A plurality of cutting blades are removably secured to the periphery of the strike plate inside the cavity. Cutting surfaces of the blades cut through the panel to form the opening when the strike plate is moved to its extended position. A strike plug extends from outside the cavity through the base and strike plate into the cavity. The strike plug is secured to the strike plate so that the strike plug moves the strike plate from the retracted position to the extended position when impulsive force is applied to the first end of the strike plug. A return assembly is provided for returning the strike plate to its retracted position after actuation of the cutting device. Ejector posts secured to the base of the housing extend into the cavity to prevent a section of the panel cut by the cutting blades to define the opening from entering the cavity.

15 Claims, 3 Drawing Sheets

DRYWALL OUTLET CUTTER

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to building construction tools, and in particular a device for cutting an opening having a predetermined shape into drywall to allow for insertion of an electrical fixture therein.

In commercial or residential building construction, boxes or enclosures adapted to accommodate electrical fixtures such as telephone or power outlets typically are installed in the interior walls, ceilings or wall frame studs, and then the walls, ceilings or studs are covered with prefabricated material such as drywall panels or plasterboards. Prior to mounting the drywall panels, it is customary to measure the location of the fixture or box on the wall or ceiling, and then cut openings in the panels at corresponding locations.

The panel openings typically are cut with a knife or drywall saw. Other cutting tools have been developed for this purpose, including those set forth in U.S. Pat. Nos. 5,048,190, issued Sep. 17, 1991 to Aurness et al.; 4,087,913, issued May 9, 1978 to Jackson; 4,335,511, issued Jun. 22, 1982 to Bowling; 4,730,395, issued Mar. 15, 1988 to Blessing; 4,951,395, issued Aug. 28, 1990 to Lameiro; and 4,969,296, issued Nov. 13, 1990 to Dominguez. However, many of these cutting tools include complicated mechanisms that are difficult to operate, require additional electrical tools to operate, or require considerable clean-up time alter cutting an opening because the cut out drywall section is tightly retained in the tool.

Thus, it is desirable to provide a device that quickly and precisely cuts openings in drywall panels or boards, and is easy to operate. Such a device should automatically discard the cut out drywall section, thereby allowing the cutter to be reused immediately, without cleaning or preparation.

BRIEF SUMMARY OF THE INVENTION

Accordingly, one object of the present invention is to provide an improved device for cutting predetermined shapes in dry wall panels or boards.

Another object of this invention is to provide an improved drywall cutting device that is hand-held and easy to operate.

Still another object of this invention is to provide an improved cutting device for quickly and precisely cutting openings in dry wall panels or boards.

Yet another object of this invention is to provide an improved device that can efficiently cut multiple openings in drywall without requiring clean-up or preparation of the device before cutting each opening.

These and other objects will become apparent to those skilled in the art in light of the following disclosure and accompanying drawings.

In accordance with the invention, generally stated, a device is provided for cutting openings having, a predetermined shape in a panel made of prefabricated material. The device includes a housing having a base with a shape corresponding to the predetermined shape of the opening.

An integrally formed side wall extends outwardly from the base in a substantially perpendicular fashion. The base and side wall define a cavity therebetween. The cutting device also includes a strike plate sized to be slidably received inside the cavity. The strike plate has a shape corresponding to that of the predetermined shape of the opening. The strike plate is movable within the cavity between a normally retracted position, wherein the strike plate is maintained in abutment with the base, and an extended position.

The cutting device further includes a plurality of cutting blades removably secured to the periphery of the strike plate inside the cavity. Each of the cutting blades has a cutting surface extending outwardly from the strike plate. The cutting surfaces are provided for cutting through the panel to form the opening. When the strike plate is moved to its extended position, the cutting surfaces cut through the panel. A manually actuated strike plug is further provided that includes a first end positioned outside of the cavity a body extending through an opening formed in the base and through the strike plate into the cavity, and a second end positioned inside the cavity. The plug body is secured to the strike plate. The strike plug moves the strike plate from the retracted position to the extended position when impulsive force is applied to the first end of the strike plug.

The cutting device preferably includes two or more ejector posts secured to the base of the housing and extending through openings formed in the strike plate into the cavity. The ejector posts prevent a section cut from the panel by the blades from entering the cavity.

Means also is provided for returning the strike plate to its retracted position. In the preferred embodiment, a return assembly is provided that includes a compression spring wound around each ejector post between an inner end of the ejector post positioned inside the cavity and the strike plate. The compression spring is biased to normally maintain the strike plate in the retracted position. When the strike plate is moved by impulsive force applied to the strike plug, the compression spring is compressed. When the impulsive force is removed, the spring recoils, thereby forcing the strike plate to return to its retracted position.

Other objects and features will be apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
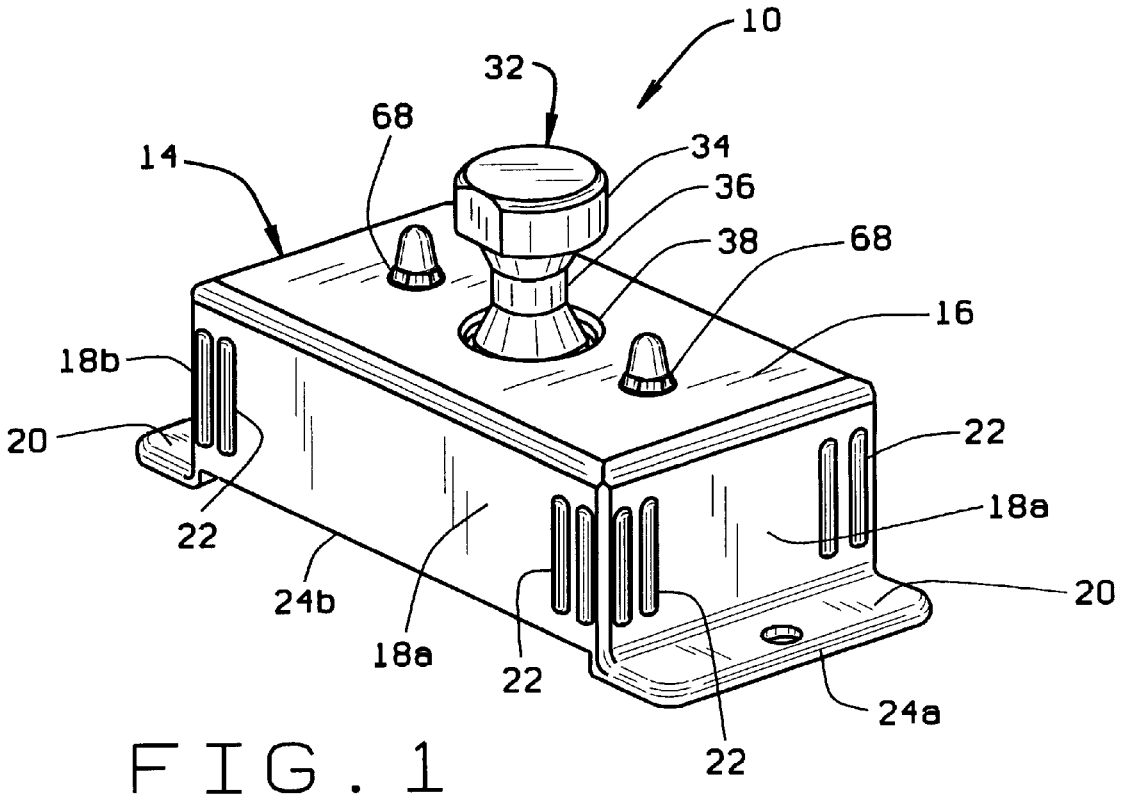
FIG. 1 is a perspective view of the cutting device of the present invention.

Referring now to FIG. 1, a cutting device is shown, referred to generally by reference numeral 10, for cutting one or more openings in prefabricated material such as drywall panels or boards 12, or similar prefabricated material. In the embodiment shown in FIG. 1, the cutting device includes a housing 14 having a substantially rectangular base 16 and an integrally formed side wall 18 extending outwardly from the peripheral edge of the base in a substantially perpendicular fashion. In the embodiment shown in FIGS. 1–4, an integrally formed flange 20 extends outwardly from the outermost ends of two opposing portions of the side wall 18*a*, 18*b* in a substantially perpendicular fashion. The flanges 20 assist the user in positioning the cutting device 10 on the panel 12 during operation of the device 10. Alternatively, one continuous flange (not shown) can extend outwardly from the outermost end of the side wall 18 in a substantially perpendicular fashion. Another embodiment of the cutting device (not shown) does not include a flange along the outermost ends of any portion of the side wall.

A plurality of outwardly extending ridges 22 are disposed on the exterior surface of the side wall 18 to assist the user in gripping the cutting device 10 during operation. The flanges 20 also assist the user in positioning the cutting device on the panel 12 during operation. In the preferred embodiment shown in FIG. 1, marks 24*a* indicating units of measurement (e.g., inches or centimeters) are included along the outer edge of the flanges, and marks 24*b* similarly are included along the outermost edges of the two opposing portions 18*c*, 18*d* of the side wall 18 that do not have a flange 20.

Figure 2A:
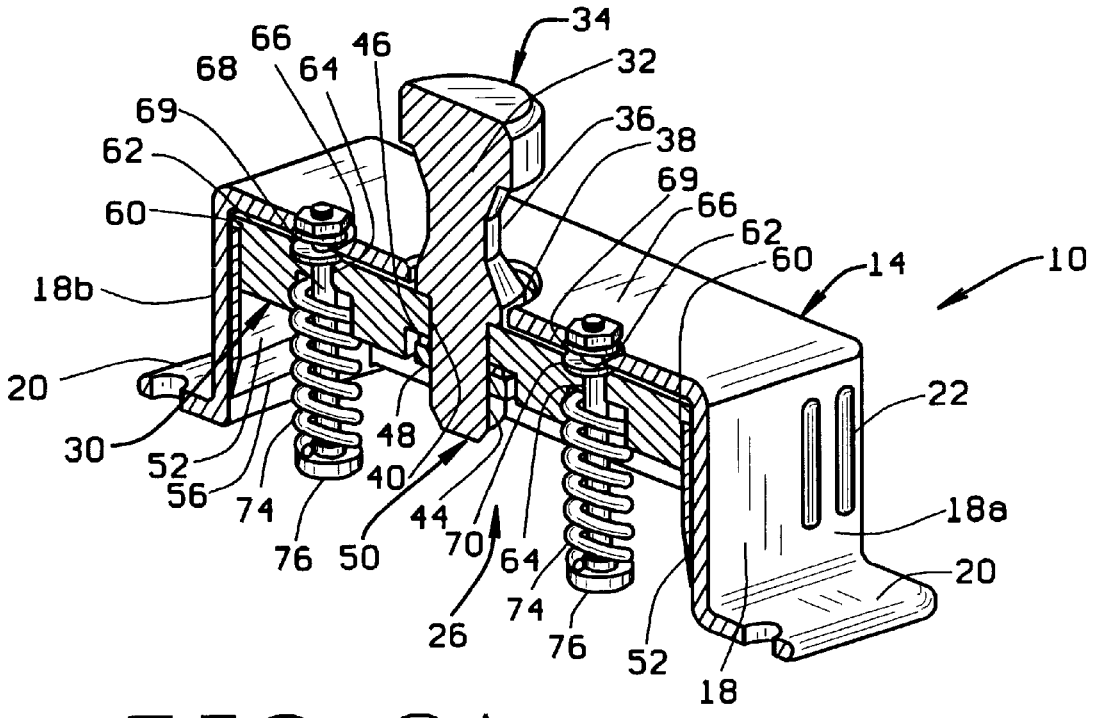
FIG. 2A is a perspective sectional view of the cutting device in FIG. 1, with the strike plate in its retracted position.
Figure 2B:
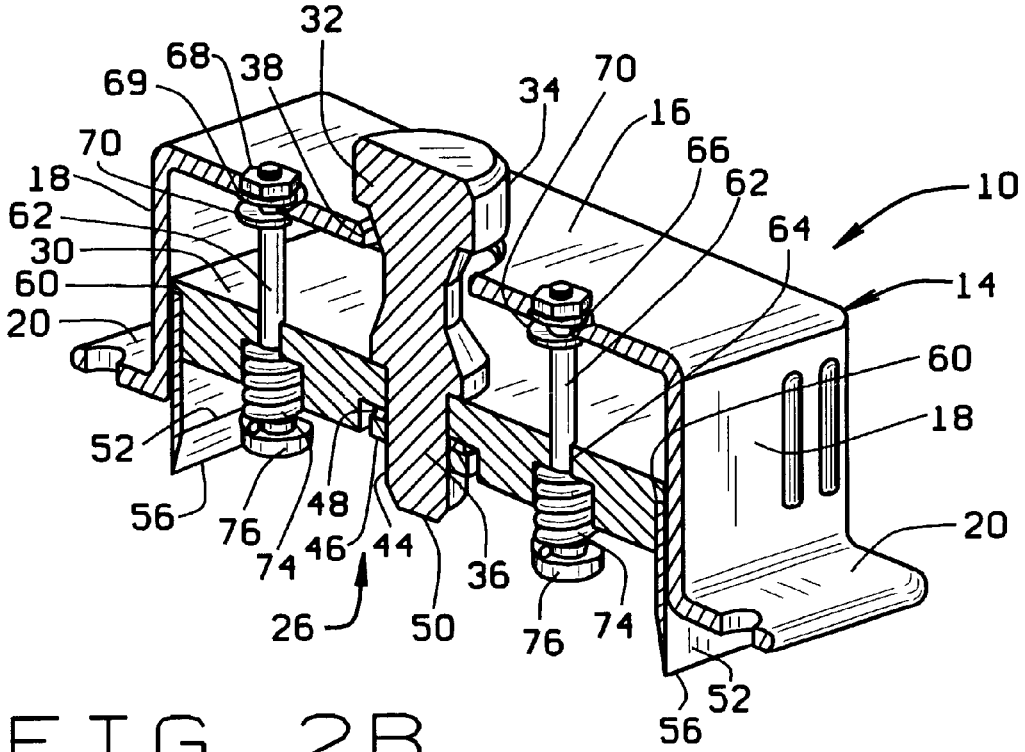
FIG. 2B is a perspective sectional view of the cutting device, with the strike plate in its extended position.

The base 16 and side wall 18 define a cavity 26 therebetween in which is disposed a strike plate 30. The strike plate 30 is sized to be slidably received inside the cavity 26, with its overall dimensions being slightly less than those of the base 16. A strike plug 32 is provided for slidably moving the strike plate 30 inwardly in the cavity 26 toward the drywall panel 12. More specifically, the strike plug 32 includes a substantially circular strike head 34 at one end, and a shaft or body 36 extending from the strike head 34. The plug body 36 is inserted through an opening 38 formed in the base 16, and through an opening 40 formed in the strike plate 30 such that a portion 44 of the body 36 extends inwardly inside the cavity 26 as shown in FIG. 2A. In the preferred embodiment, the portion of the plug extending through the strike plate is helically threaded. A lock washer 46 and nut 48 are screwed onto the threaded portion of the plug body 36 to securely retain the plug body 36 to the plate 30.

Figure 3:
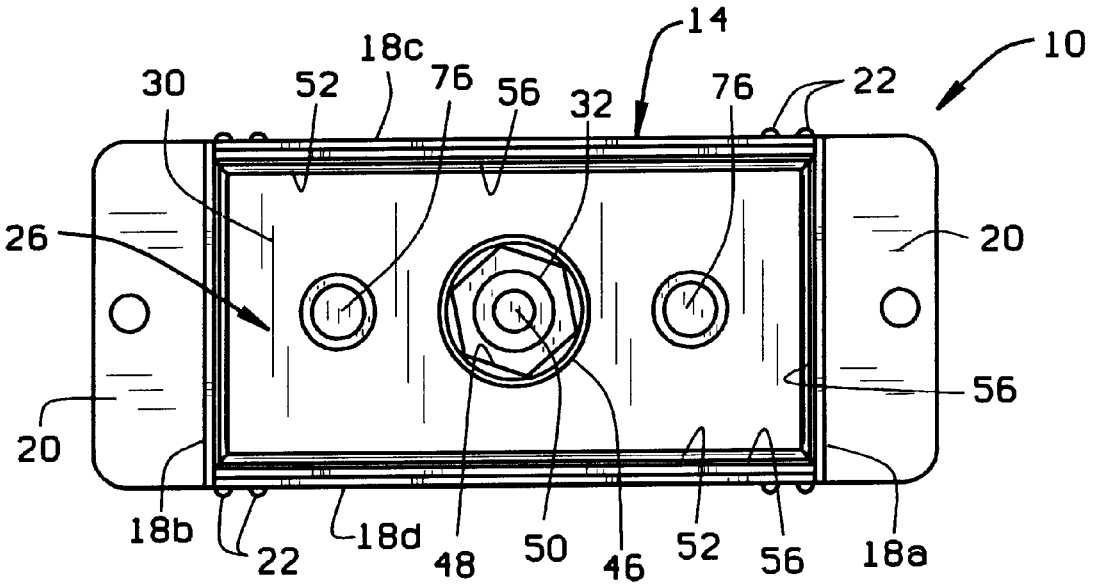
FIG. 3 is a bottom plan view of the cutting device.
Figure 4:
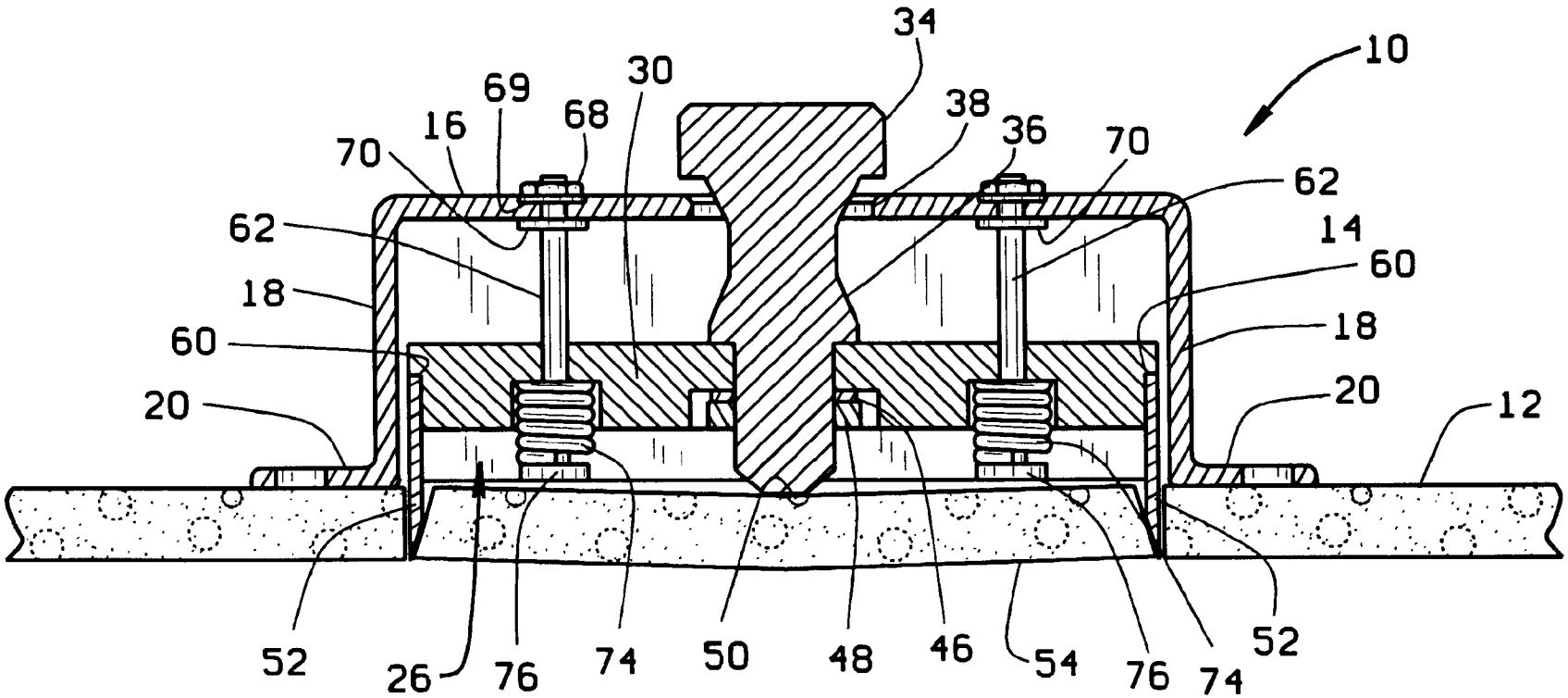
FIG. 4 is a sectional side view of the cutting device positioned on a drywall panel, showing the strike plate in its extended position.

The portion 44 of the plug body 36 extending inwardly from the strike plate 30 into the cavity 26 includes a strike point 50 formed at its innermost end. A set of blades 52 also are provided to assist in cutting an opening in the panel 12. As discussed below, the blades 52 and strike point 50 engage the panel 12 when the strike plug 32 is actuated. The blade 52 are positioned inside the cavity 26 along the side wall 18 as shown in FIGS. 2–4 such that cutting edges 56 of the blades extend outwardly toward the outermost edge of the side wall 18. The blades 52 are removably secured to the strike plate 30 so that each blade 52 can be replaced or sharpened if it becomes dull. More specifically, the strike plate 30 has an L-shaped notch 60 formed around its outer periphery. The blade is frictionally retained in the notch 60 during operation of the cutter 10. As discussed below, the blades 52 slidably move along the side wall 18 during operation of the cutter 10.

The cutting device 10 also includes two ejector posts 62 that extend from the cavity 26 through openings 64 in the strike plate 30 and openings 66 in the base 16 of the housing 14. As shown in FIG. 2A, each ejector post is securely mounted to the housing by a nut 68 (e.g., an acorn nut) and a lock washer 69 that are attached to a threaded end of each post 62. In the preferred embodiment, a stop mechanism 70, such as, for example, a retaining clip or an integrally formed flange, extends radially outwardly from the ejector post to limit outward movement of the ejector post from the cavity 26 through the opening 66 in the base 16. The strike plate 30 is normally biased in a retracted position in abutment with the base 16 of the housing 14 as shown in FIG. 2A by a compression spring 74 that is helically wrapped around the post 62 between the strike plate 30 and a head 76 of the post 62. As discussed below, when the strike plug 32 is actuated by inwardly pressing or impulsive force, the strike plate 30 is moved into an extended position toward the drywall panel, thereby compressing the spring (see FIGS. 2B and 4). When the force is removed from the strike plug 32, the compression springs 74 recoil, thereby forcing the strike plate 30 to return to its retracted position. The heads 76 of the ejector posts engage the drywall panel 12, and force a section 54 of panel cut by the blades to form the opening to fall outside of the housing 14.

In operation, the flanges 20 and outermost end of the side wall 18 are placed on prefabricated material such as drywall panel or board 12 in a desired location where the hole is to be cut. Force then is applied to the head 34 of the strike plug 32, moving the plug 32 inwardly toward the panel 12. In the preferred embodiment, a hammer or other striking tool is used to exert impulsive force on the plug 32 by striking the plug head 34, thereby causing inward movement of the strike plate 30, against the resistance of the compression springs 74 (see FIG. 2B).

As the strike plate 30 moves inwardly toward the panel or board 12, the cutting blades 52 are moved inwardly into engagement with the panel 12, cutting the section 54 of panel 12 to define the hole. The strike point 50 of the plug 32 engages the panel 12 as strike plate 30 moves inwardly and the blades cut through the panel 12. As the strike plug 32 moves inwardly, the strike point 50 breaks the section 54 of panel 12, thus assisting the blades 52 in creating the desired opening. In the preferred embodiment, the strike point 50 engages the panel 12 at approximately 60% of stroke travel to minimize friction between the cutting blades 52 and the panel 12. Thus, when the strike plug 32 is actuated by the striking tool, the cutting blades 52 cut through the panel 12 as the strike point 50 and ejector posts 62 push the cut-out section 54 of the panel 12 away from the cavity 26 of the cutting device 10, as shown in FIG. 4.

After the section 54 is cut from the panel 12 and discarded from the cavity 26, the impulsive force can be removed from the strike plug 32. When the impulsive force is removed, the compression springs 74 force the strike plate 30 to move from its extended position to the retracted position as shown in FIG. 2A. The cutting device 10 then can be removed from the panel 12, and positioned in another location, if desired, to cut another opening.

The cutting device 10 shown in the drawings is used to cut sections 54 from the panel to create openings having a substantially rectangular shape. It will be appreciated by those skilled in the art that the shape of the opening can easily be varied by varying the dimensions of the housing base 16 and side wall 18, and the orientation of the cutting blades 52. For example, if a square opening is desired, the base 16 has a square configuration with all peripheral edges having substantially equal lengths, and the side wall 18 extending outwardly from the base 16 in a substantially perpendicular fashion. In this situation, the strike plate 30 also has a square configuration with overall dimensions slightly less than those of the base 16 so that the strike plate 30 can slidably move inside the cavity 26 operation of the cutter 10. The cutting blades 52 are positioned in notches 60 formed in the periphery of the strike plate 32 in a generally square orientation. Similarly, if an octagonal opening is desired, the base 16 of the housing 14 has a substantially octagonal configuration, with the side wall 18 extending outwardly from the periphery of the base 16 in a substantially perpendicular fashion. The strike plate 30 also has an octagonal shape with dimensions slightly less than those of the base 16. The cutting blades 52 are positioned in the notches 60 of the strike plate 30, along the side wall 18 inside the cavity 26. Thus, the base 16 of the housing 14 and the strike plate 30 preferably have shapes corresponding to the predetermined shape of the opening, with the overall dimensions of the strike plate 30 being slightly less than those of the base 16 so that the strike plate 30 can slidably move between the retracted and extended positions inside the cavity 26.

In view of the above, it will be seen that the several objects and advantages of the present invention have been achieved and other advantageous results have been obtained.

The foregoing description is set forth only for illustrative purposes only and is not meant to be limiting. As various changes could be made in the above constructions without departing from the scope of the invention, it is intended that all matter contained in the above description or shown in the accompanying drawings shall be interpreted as illustrative and not in a limiting sense. Numerous variations, within the scope of the appended claims will be apparent to those skilled in the art in light of the foregoing description and accompanying drawings.

I claim:

1. A device for cutting openings having a predetermined shape in a panel made of prefabricated material, comprising:

a housing including a base and an integrally formed side wall extending outwardly from the periphery of the base in a substantially perpendicular fashion, the base and the side wall defining a cavity therebetween;

a strike plate sized to be slidably received inside the cavity, and having a shape corresponding to that of the predetermined shape of the opening, the strike plate being movable within the cavity between a normally retracted position wherein the strike plate is maintained in abutment with the base and an extended position;

a plurality of cutting blades removably secured to the periphery of the strike plate inside the cavity, each of the cutting blades having a cutting surfaces extending outwardly from the strike plate, the cutting surfaces being provided for cutting through the panel to form the opening, the cutting surfaces cutting through the panel when the strike plate is moved to its extended position; and a strike plug extending from outside the cavity through the base and strike plate into the cavity, the strike plug including a first end positioned outside of the cavity and a second end positioned inside the cavity, the strike plug being secured to the strike plate, the strike plug moving the strike plate from the retracted position to the extended position when impulsive force is applied to the first end of the strike plug;

further including a return assembly for returning the strike plate to its retracted position; and at least two ejector posts secured to the base of the housing and extending through openings formed in the strike plate into the cavity, the ejector posts preventing a section of the panel cut by the cutting blades to define the opening from entering the cavity.

2. The device of claim 1, wherein the return assembly includes a compression spring positioned around each ejector post between an inner end of the post disposed inside the cavity and the strike plate, the compression spring being biased to normally maintain the strike plate in the retracted position, and to return the strike plate to the retracted position after impulsive force is removed from the strike plug.

3. The device of claim 1, wherein the strike plug includes a body extending between the first and second ends, a portion of the strike plug body being helically threaded, a lock washer and nut being secured to the threaded body portion to secure the strike plug to the strike plate.

4. The device of claim 1, wherein the base has a shape corresponding to the predetermined shape of the opening, and dimensions slightly greater than the dimensions of the strike plate such that the strike plate is slidably received inside the cavity.

5. The device of claim 4, wherein the strike plate includes a notch formed at its periphery that is adapted to snugly receive an end of the cutting blades that is opposite the cutting surfaces.

6. The device of claim 1, further including at least two flanges integrally formed with and extending outwardly from an outer edge of the side wall in a substantially perpendicular fashion, the flanges being disposed at substantially opposite locations along the outer edge of the side wall to assist in positioning the cutting device at a desired location on the panel during operation of the device.

7. The device of claim 1, further including a flange integrally formed with and extending outwardly from an outer edge of the side wall in a substantially perpendicular fashion to assist in positioning the cutting device at a desired location on the panel during operation of the device.

8. The device of claim 1, wherein the strike plug is manually actuated by a striking tool that applies impulsive force to the first end of the strike plug.

9. The device of claim 1, wherein the strike plate has a substantially rectangular shape.

10. The device of claim 1, wherein the strike plate has a substantially square shape.

11. The device of claim 1, wherein the strike plate has a substantially circular shape.

12. The device of claim 1, wherein the strike plate has a substantially octagonal shape.

13. The device of claim 1, further including a plurality of ridges integrally formed with and extending outwardly from the side wall to assist a user in gripping the device during operation.

14. A device for cutting openings having a predetermined shape in a drywall panel, comprising:

a housing including a base having a shape corresponding to the predetermined shape of the opening and an integrally formed side wall extending outwardly from the periphery of the base in a substantially perpendicular fashion, the base and the side wall defining a cavity therebetween;

a strike plate sized to be slidably received inside the cavity, and having a shape corresponding to that of the predetermined shape of the opening, the strike plate being movable within the cavity between a normally retracted position wherein the strike plate is maintained in abutment with the base and an extended position;

a plurality of cutting blades removably secured to the periphery of the strike plate inside the cavity, each of the cutting blades having a cutting surfaces extending outwardly from the strike plate, the cutting surfaces being provided for cutting through the panel to form the opening, the cutting surfaces cutting through the panel when the strike plate is moved to its extended position;

a manually actuated strike plug extending through the base and strike plate, including a first end positioned outside of the cavity and a second end positioned inside the cavity, the strike plug being secured to the strike plate, the strike plug moving the strike plate from the retracted position to the extended position when impulsive force is applied to the first end of the strike plug;

a return assembly for returning the strike plate to its retracted position; and a pair of ejector posts secured to the base of the housing and extending through the strike plate into the cavity, the ejector posts preventing a section of the panel cut by the cutting blades to define the opening from entering the cavity.

15. The device of claim 14, wherein the return assembly includes a compression spring positioned around each ejector post between an inner end of the post disposed inside the cavity and the strike plate, the compression spring being biased to normally maintain the strike plate in the retracted position, and to return the strike plate to the retracted position after impulsive force is removed from the strike plug.

* * * * *